US007470152B2

(12) United States Patent
Kuo

(10) Patent No.: US 7,470,152 B2
(45) Date of Patent: Dec. 30, 2008

(54) CABLE CONNECTOR ASSEMBLY

(75) Inventor: Peter Kuo, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/895,774

(22) Filed: Aug. 27, 2007

(65) Prior Publication Data

US 2008/0050976 A1 Feb. 28, 2008

(51) Int. Cl.
*H01R 24/04* (2006.01)

(52) U.S. Cl. ..... 439/668

(58) Field of Classification Search ..... 439/668, 439/271, 347, 951, 60, 11, 640, 638
See application file for complete search history.

(56) References Cited

U.S. PATENT DOCUMENTS 5,168,876 A * 12/1992 Quedens et al. ..... 600/376
5,810,620 A * 9/1998 Kobayashi et al. ..... 439/610
6,616,487 B1 9/2003 Lai
6,626,710 B1 * 9/2003 Tsai Huang ..... 439/825
7,172,428 B2 * 2/2007 Huang ..... 439/11
2003/0012362 A1 * 1/2003 Khemakhem et al. ..... 379/398

* cited by examiner

*Primary Examiner*—Jean F Duverne
(74) *Attorney, Agent, or Firm*—Wei Te Chung

(57) ABSTRACT

A cable connector assembly comprises a shell (1) comprising a receiving space (14), a cable (4) having a plurality of wires (41), an audio plug (2) mounted on the shell and including a plurality of electrodes, the audio plug having a mating portion (23), a retaining portion (22) and a soldering portion (21), the mating portion being columnar, the electrodes being located and insulated from each other in an axial direction at the mating portion (23); and at least one PCB (3) disposed in the receiving space to establish an electrical connection between the wires (41) of the cable and the soldering portion (21) of the audio plug.

13 Claims, 7 Drawing Sheets

CABLE CONNECTOR ASSEMBLY

BACKGROUND OF THE INVENTION

1. Field of the Invention

The present invention relates to a cable connector assembly, and particularly to a cable connector assembly having an audio plug.

2. Description of Prior Arts

Nowadays, internet becomes an important part in people's life. People are conditioned to get information, music, movie and software from the internet. MP3 is the most popular format of music on the internet, and people can use MP3 players to enjoy the music in MP3 format. The MP3 players are young men's favorite. People like to enjoy music everywhere, and there are some auxiliary devices for the MP3 player to achieve their requirement. FIG. 6 shows a portable MP3 player. The MP3 player has a device for user to take it while walking. The device defines an audio plug electrically connecting with a cable as shown in FIG. 7. The cable is soldered to the audio plug in a conventional way. A conventional audio plug includes a plurality of electrodes for transmitting different signals. A new audio plug including more electrodes is needed to achieve multi-purpose; however, that leaves a smaller portion to be soldered to the cable under the miniaturized tendency. Besides, every two electrodes must be insulated from each other to prevent short-circuit. Accordingly, the cable is hard to be soldered to the audio plug.

Obviously, we need a new cable connector assembly to resolve above mentioned problem.

SUMMARY OF THE INVENTION

An object of the present invention is to provide a cable connector assembly with an audio plug, which the cable located in the cable connector assembly is more easily electrically connected to the audio plug.

To achieve the above object, A cable connector assembly comprises a shell comprising a receiving space, a cable having a plurality of wires, an audio plug mounted on the shell and including a plurality of electrodes, the audio plug having a mating portion, a retaining portion and a soldering portion, the mating portion being columnar, the electrodes being located and insulated from each other in an axial direction at the mating portion; and at least one PCB disposed in the receiving space to establish an electrical connection between the wires of the cable and the soldering portion of the audio plug.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
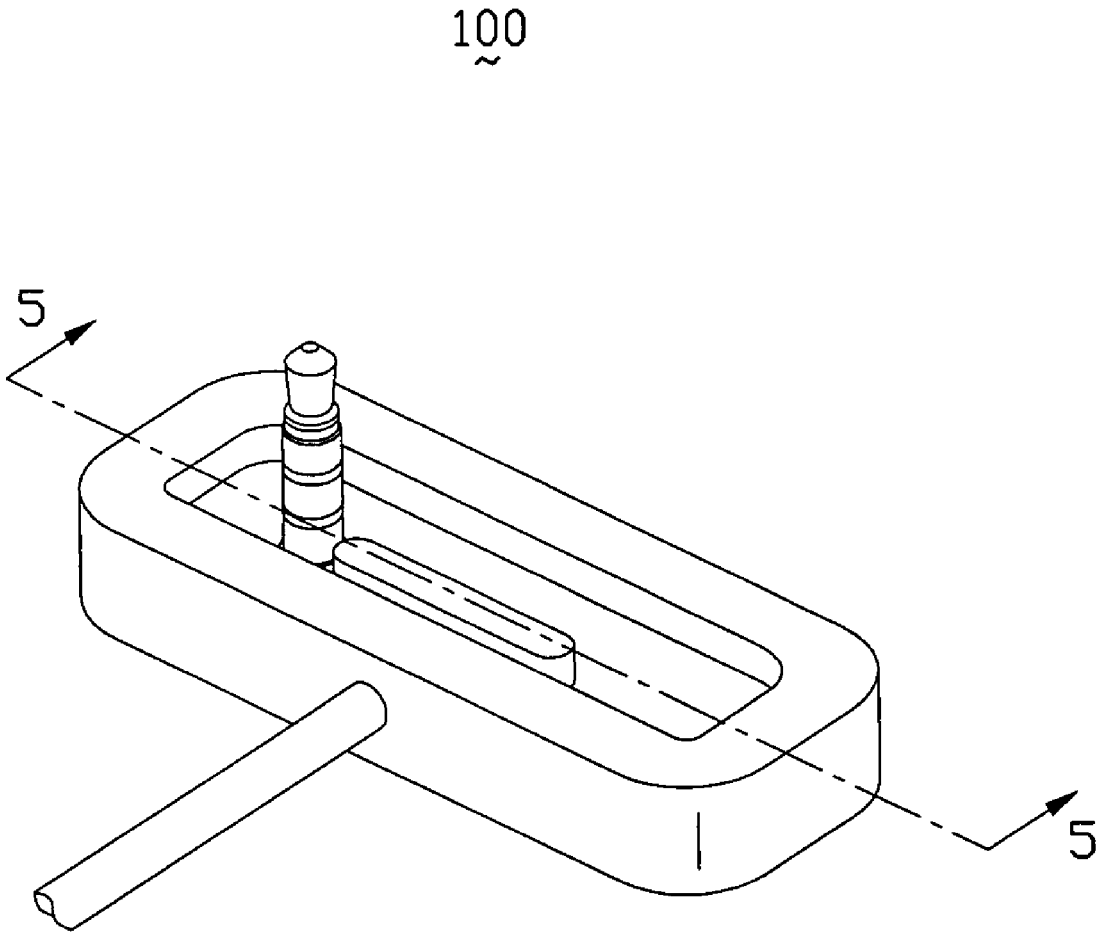
FIG. 1 is an assembled, perspective view of a cable connector assembly in accordance with the present invention.
Figure 2:
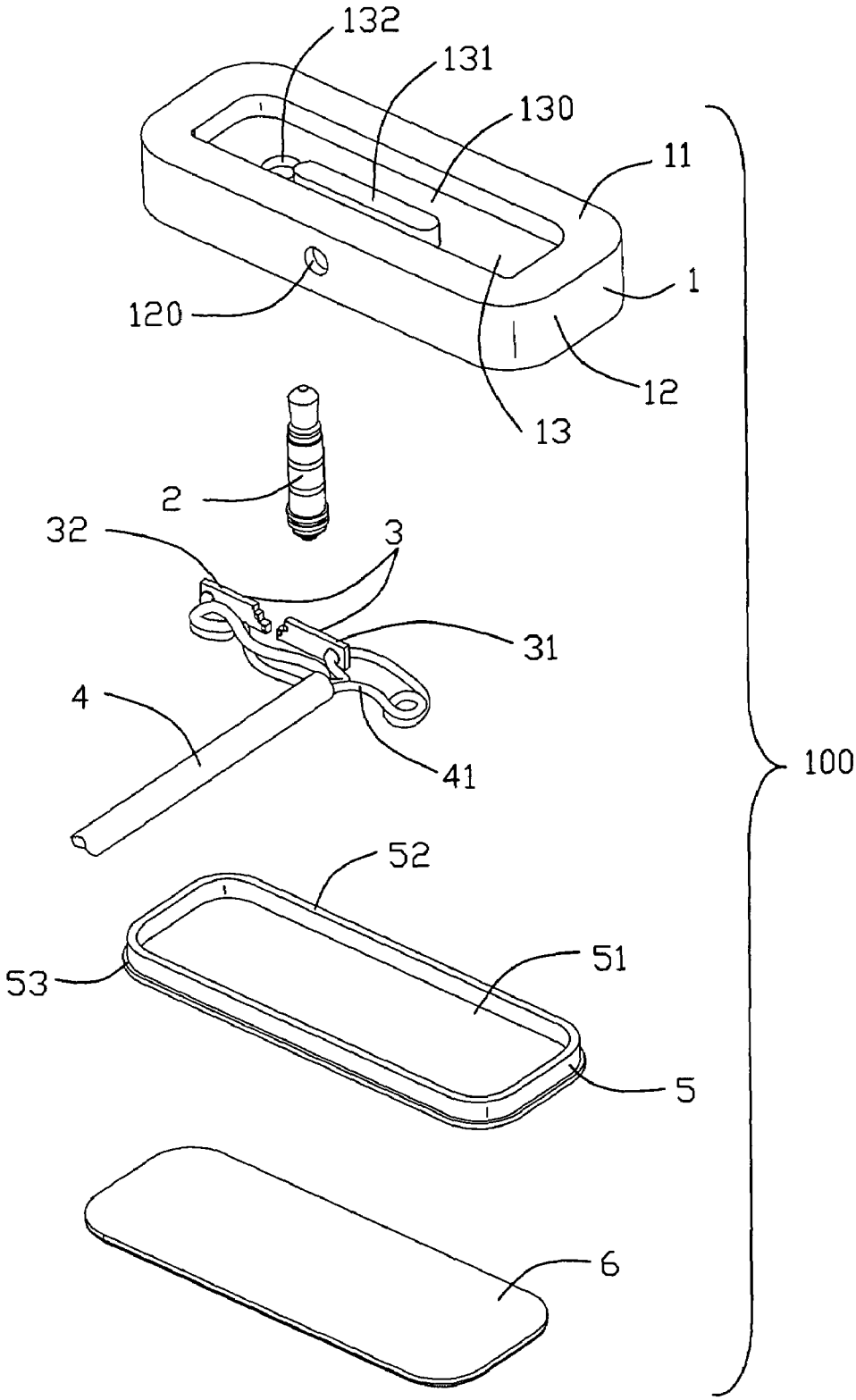
FIG. 2 is an exploded view of the cable connector assembly shown as FIG. 1.
Figure 3:
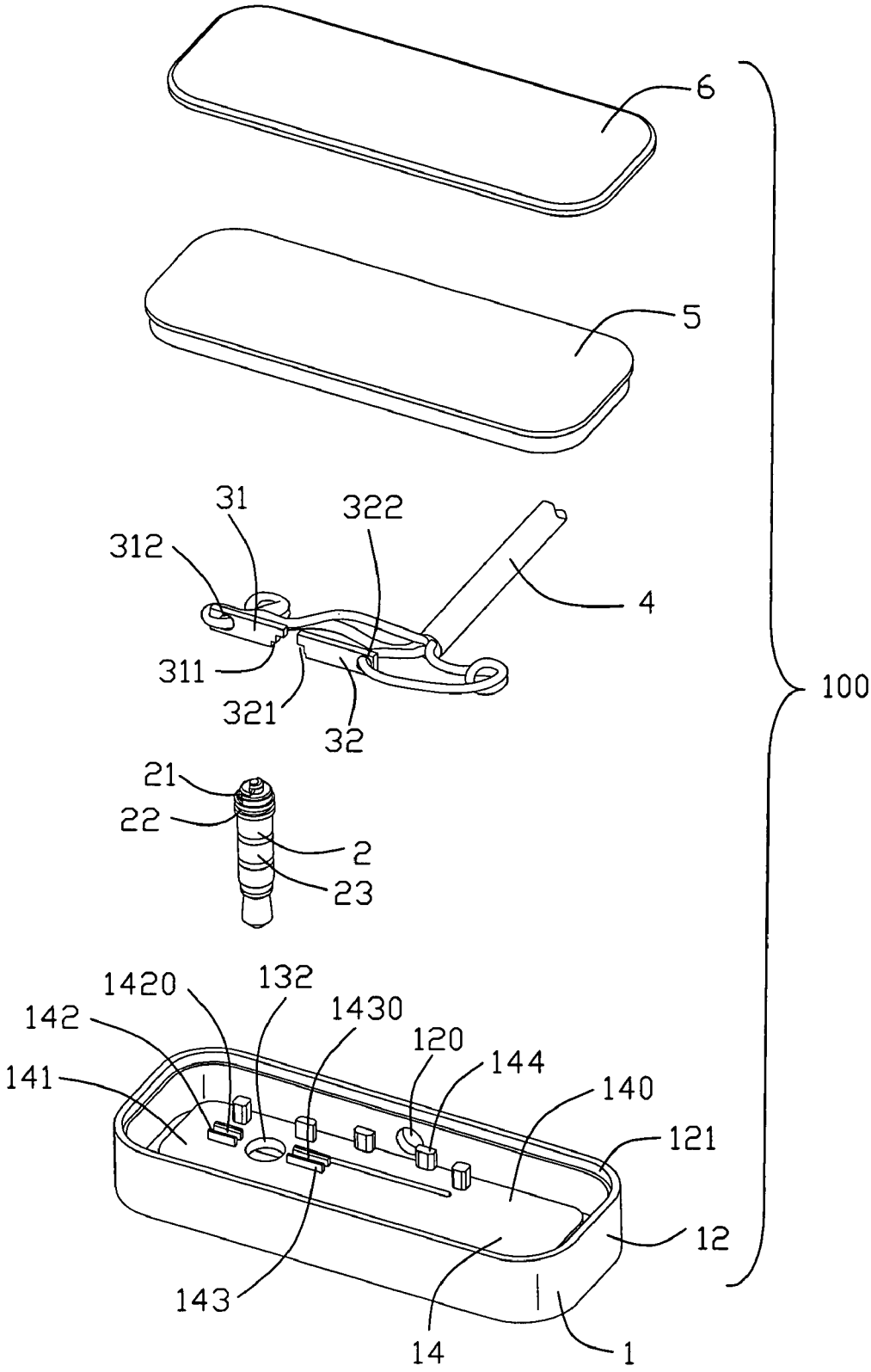
FIG. 3 is a view similar to FIG. 2, but taken from a different aspect.

Referring to FIGS. 1-3, the present invention relates to a cable connector assembly 100. The cable connector assembly 100 includes a shell 1, an audio plug 2, a pair of printed circuit boards (PCB) 3, a cable 4, a retainer 5 and a board 6. The shell 1 comprises a top wall 11 and a lateral wall 12 extending downwardly from the top wall 11. The top wall 11 forms a depressed portion 13 with a bottom surface 130. A holding block 131 extends from the bottom surface 130 of the depressed portion 13. The bottom surface 130 defines a hole 132 adjacent to the holding block 131. The top surface (not labeled) of the holding block 131 is at the same level as the top wall 11 of the shell 1. One side of the lateral wall 12 defines a cable receiving passage 120. The top wall 11 and the lateral wall 12 define a receiving space 14. Said depressed portion 13 forms a platform 140 in the receiving space 14. The platform 140 includes a planar surface 141, a pair of first ribs 142 and a pair of second ribs 143 forming on the planar surface 141. The pair of first ribs 142 defines a first channel 1420, and the pair of second ribs 143 defines a second channel 1430. Said hole 132 defined in the bottom surface 130 is disposed between the pair of firs ribs 142 and the pair of second ribs 143. A plurality of posts 144 formed on the planar surface 141 are positioned at one side of the first and second ribs 142, 143 adjacent to the cable receiving passage 120. A ladder portion 121 are formed along the inner surface of the lateral wall 12.

Figure 4:
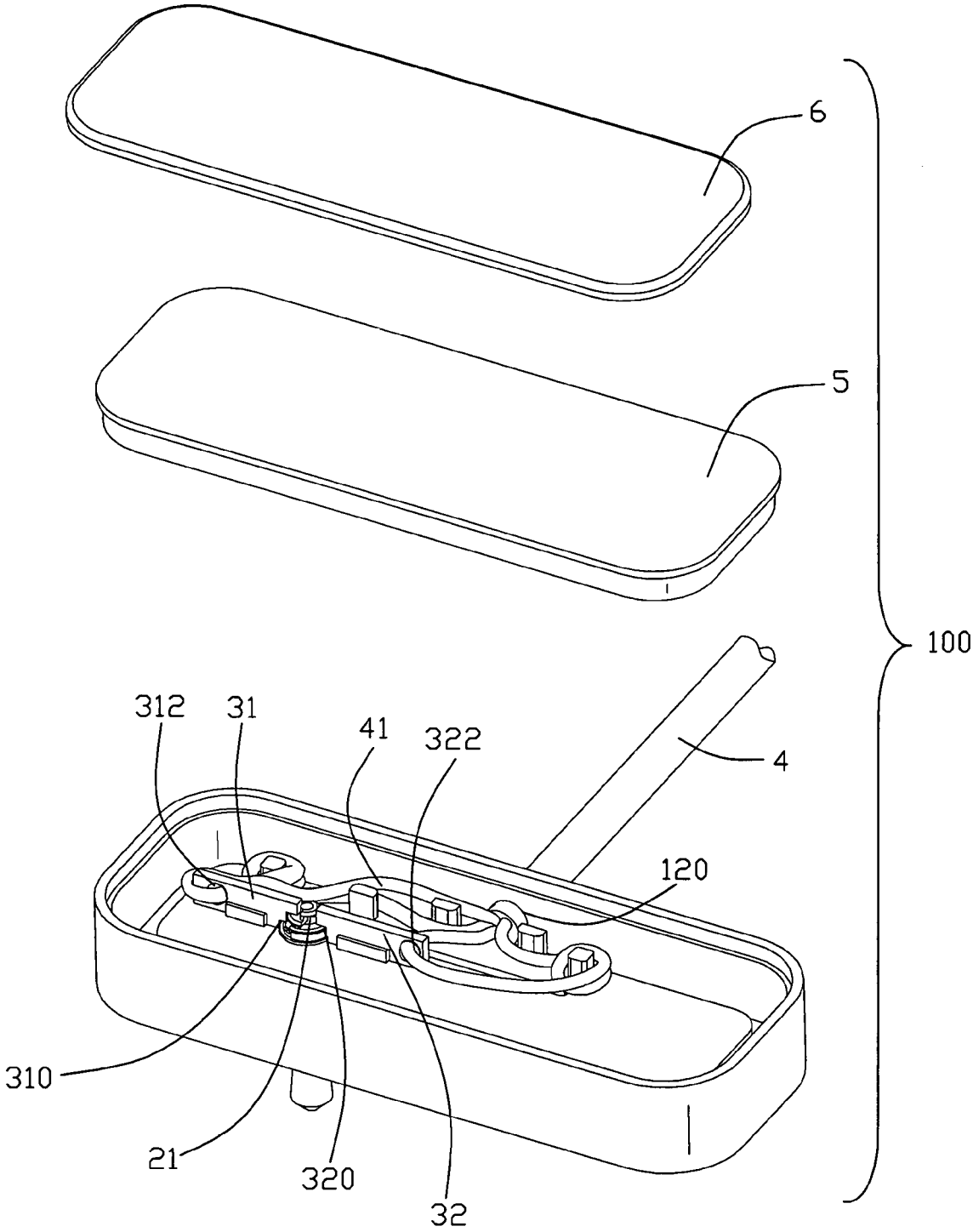
FIG. 4 is a view of the cable connector assembly shown as FIG. 3 with retainer 5 and board 6 removed.
Figure 5:
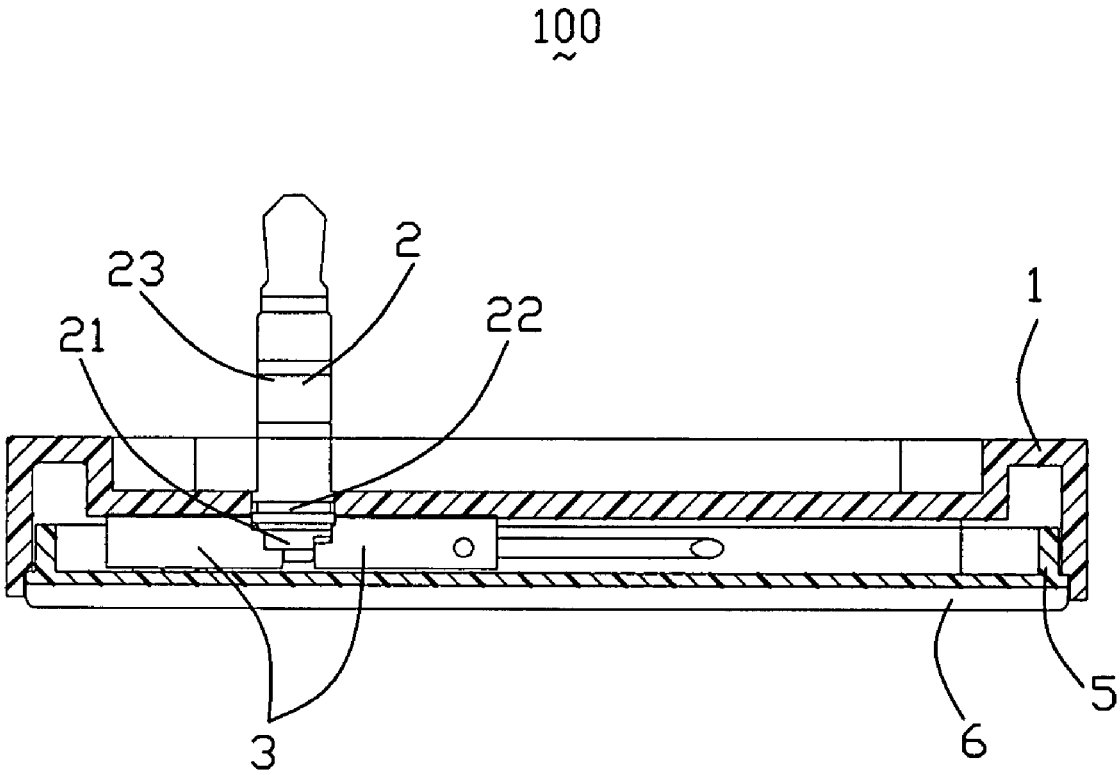
FIG. 5 is a cross-sectional view along the line 5-5 of the cable connector assembly shown in FIG. 1.
Figure 6:
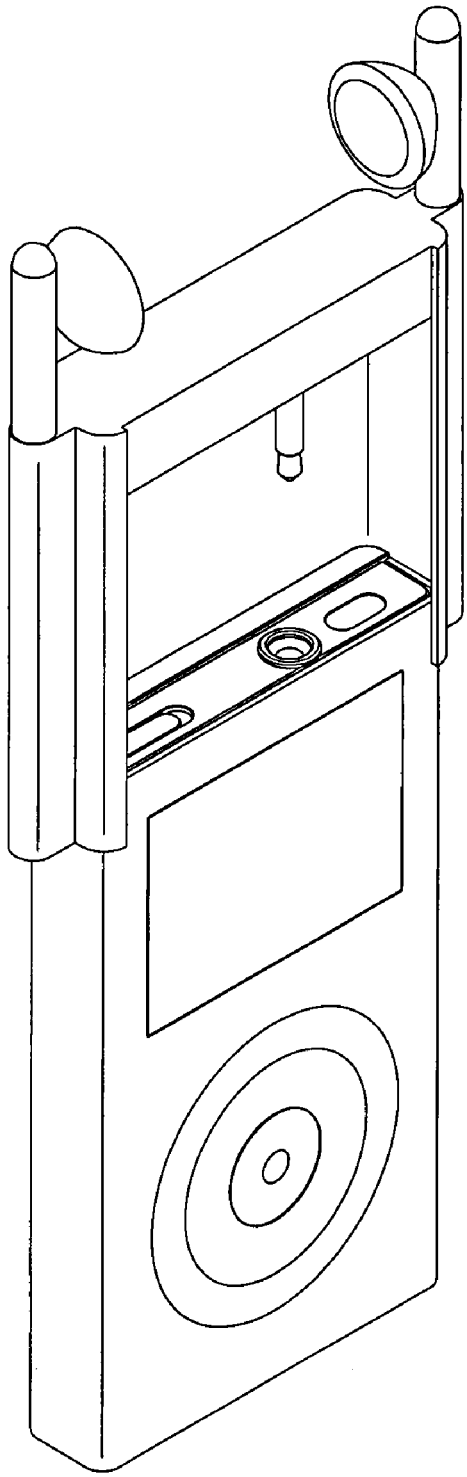
FIG. 6 (PRIOR ART)
FIG. 6 is a perspective view of the prior art.
Figure 7:
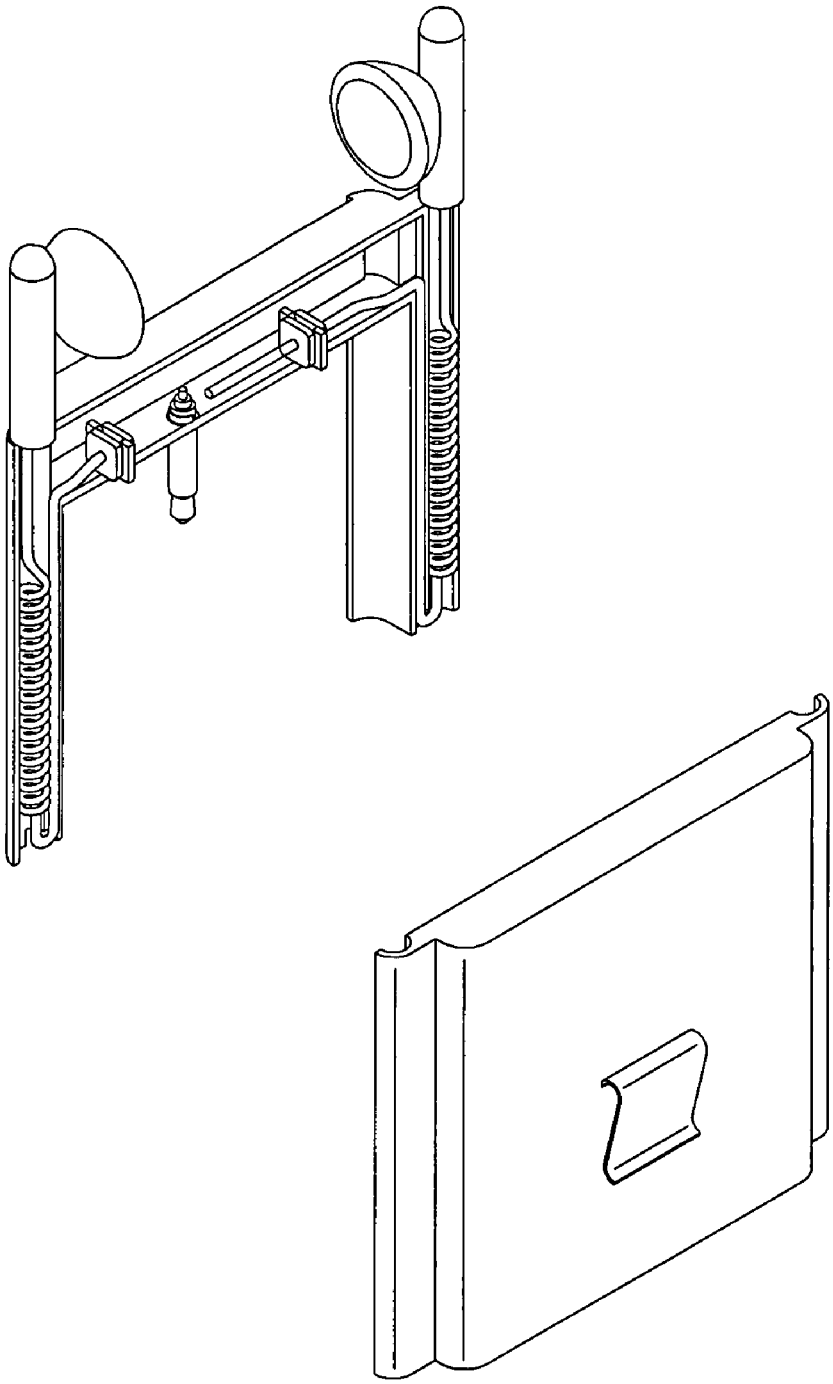
FIG. 7 (PRIOR ART)
FIG. 7 is an exploded view of the prior art.

As shown in FIGS. 4 and 5, the audio plug 2 includes a plurality of electrodes (not labeled), and each electrode defines a soldering portion 21, a mating portion 23 and a retaining portion 22 connecting the soldering portion 21 and the mating portion 23. The mating portion 23 is configured of a column, and the electrodes are insulated from each other in the vertical direction. The retaining portion 22 of the audio plug 2 is retained in the hole 132 of the shell 1, the soldering portion 21 of the audio plug 2 is located in the receiving space 14 and the mating portion 23 extends out of the shell 1 from the bottom surface 130 of the depressed portion 13. The pair of PCBs 3 comprises a first PCB 31 and a second PCB 32. The first PCB 31 and the second PCB 32 are vertically received in the first channel 1420 and the second channel 1430, respectively. The soldering portion 21 of the audio plug 2 comprises a plurality of steps, each step stands for an electrode. A first stepped portion 311 is formed at an end of the first PCB 31 and a second stepped portion 321 is formed at an end of the second PCB 32. The first PCB 31 and the second PCB 32 are disposed in mirror image, and the first stepped portion 311 and the second stepped portion 321 meet the soldering portion 21 of the audio plug 2. Each of the first stepped portion 311 and the second stepped portion 321 defines a soldering pin (not shown), respectively, to solder to corresponding soldering portion 21 of the audio plug 2. Thereby, the electrode of the audio plug 2 is electrically connected to the pair of the PCB 3. The first PCB 31 and the second PCB 32 define a first soldering part 312 and a second soldering part 322, respectively, at the ends opposite to corresponding first and second stepped portion 311, 321. The cable 4 extends into the receiving space 140 through the cable receiving passage 120. A plurality of wires 41 of the cable 4 are soldered to corresponding first and second soldering portion 312, 322, respectively. The wires 41 are received in the receiving space 14 by rounding on the posts 144 of the shell 1, so as to prevent the cable 4 from projecting out of the shell 1, and electrically connect between the pair of PCBs 3. The cable 4 electrically connects with the audio plug 2 through the pair of PCBs 3.

As shown in FIGS. 2 and 5, the retainer 5 includes a bottom surface 51 and a circular board 52 extending from the bottom surface 51. An overlapped surface 53 extends beyond the circular board 52. The retainer 5 is assembled to the receiving space 14 of the shell 1. The circular board 52 is against a insider surface (not labeled) of the receiving space 14, and the overlapped surface 53 meets the ladder portion 121 of the shell 1. At last, the board 6 is assembles to the shell 1 as a bottom face of the cable connector assembly 100. The retainer 5 is heavy to make the cable connector assembly 100 stand on a desktop stably.

The pair of PCBs 3 disposed in the cable connector assembly 100 to make the cable 4 and the audio plug 2 establish electrically connected more easily.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A cable connector assembly, comprising:

a shell comprising a receiving space;

a cable having a plurality of wires;

an audio plug mounted on the shell and including a plurality of electrodes, the audio plug having a mating portion, a retaining portion and a soldering portion, the mating portion being columnar, the electrodes being located and insulated from each other in an axial direction at the mating portion; and at least one PCB disposed in the receiving space to establish an electrical connection between the wires of the cable and the soldering portion of the audio plug;

wherein the soldering portion of the audio plug is received in said receiving space of the shell and is stepped, and the PCB has a stepped end corresponding to the soldering portion;

wherein there are two PCBs received in the receiving space of the shell, the two PCBs being mirror image of each other.

2. The cable connector assembly as described in claim 1, further comprising a retainer, the retainer being of sufficient weight to make the connector assembly stand on a desktop stably.

3. The cable connector assembly as described in claim 1, wherein the shell comprises a first channel and a second channel for receiving said pair of PCBs, respectively.

4. The cable c6nnector assembly as described in claim 3, wherein the shell defines a hole, said retaining portion of the audio plug is received in the hole, and the hole is located between the first and the second channels.

5. The cable connector assembly as described in claim 1, wherein the shell defines a cable receiving passage, and the cable extends into the receiving space through the cable receiving passage.

6. The cable connector assembly as described in claim 1, wherein a plurality of posts are formed in the receiving space of the shell, and the wires are received in the receiving space and loop around the posts.

7. A cable connector assembly comprising:

a shell comprising a receiving space;

a cable having a plurality of wires;

a columnar audio plug defining an exterior part extending out of the shell, and an interior part located within the receiving space; and at least one PCB disposed in the receiving space to establish an electrical connection between the wires of the cable and a soldering potion of the audio plug which is soldered to the PCB; wherein said PCB lies in a plane which extends parallel to an axial direction of said columnar audio plug;

wherein the plural step-like structures are formed on both said PCB and said columnar audio plug for complementary interengagement with each other;

wherein the audio plug has includes a plurality of electrodes being located and insulated from each other, wherein the audio plug defines a mating region and a solder region under a condition that the electrodes are insulated from each other axially in the mating region while radially in the soldering portion.

8. The cable connector assembly as claimed in claim 7, wherein the PCB is positioned with regard to the columnar audio plug diametrically.

9. The cable connector assembly as claimed in claim 7, wherein an axis of said columnar audio plug is coplanar with said plane.

10. The cable connector assembly as claimed in claim 8, wherein said PCB defines at least a step on an edge to radially engaged said solder portion.

11. The cable connector assembly as claimed in claim 8, wherein said solder portion is formed on a diametrical position of a circumference of the columnar audio plug.

12. The cable connector assembly as claimed in claim 7, wherein an axial length of the soldering portion is larger than a thickness of the PCB.

13. The cable connector assembly as claimed in claim 12, wherein an average diameter of the soldering portion is larger than a thickness of the PCB.

* * * * *